United States Patent [19]

Roj

[11] 4,261,526

[45] Apr. 14, 1981

[54] BRAKE MEANS FOR A YARN FEEDING DEVICE WITH CONSTANT ADJUSTABLE TENSION, PARTICULARLY FOR USE IN WEAVING AND KNITTING MACHINES

[75] Inventor: Remo Roj, Biella, Italy

[73] Assignee: ROJ Electrotex S.p.A., Biella, Italy

[21] Appl. No.: 29,153

[22] Filed: Apr. 11, 1979

[30] Foreign Application Priority Data

Apr. 11, 1978 [IT] Italy ..... 22182 A/78

[51] Int. Cl.[3] ..... B65H 51/20

[52] U.S. Cl. ..... 242/47.01; 66/132 R; 139/452; 242/47.12

[58] Field of Search ..... 139/452; 66/132 R; 242/47.01, 47.12, 47.04, 47.05, 47.08, 47.09, 47.10, 47.11, 49

[56] References Cited

U.S. PATENT DOCUMENTS

| | | | |
|---|---|---|---|
| 3,940,079 | 2/1976 | Vella | 242/47.12 |
| 3,995,786 | 12/1976 | Deniega | 242/47.01 |
| 4,161,297 | 7/1979 | Vella | 242/47.01 |

*Primary Examiner*—Henry Jaudon
*Attorney, Agent, or Firm*—Young & Thompson

[57] ABSTRACT

In a yarn feeding device with constant adjustable tension, for use in weaving and knitting machines, of the type comprising a fixed hollow body around which the yarn to be fed is wound by an external rotary element, to form thereon a yarn reserve from which the yarn is drawn to be sent to said weaving or knitting machine, passing through the inside of said fixed hollow body, a brake is provided which acts by pressing the yarn onto the edge of the said fixed body. The brake comprises a plurality of substantially radial elements of thin sheet-metal, held at the ends between an outer ring and a central hub of plastic material, which are moreover connected to each other by radial elastic laminae, said substantially radial elements being designed to be pressed onto the edge of the fixed body of said feeding device, to brake the yarn thereon thanks to the action of an adjustable setscrew which freely engages the center of said central hub, said outer ring being arranged beyond the edge of said fixed body.

4 Claims, 4 Drawing Figures

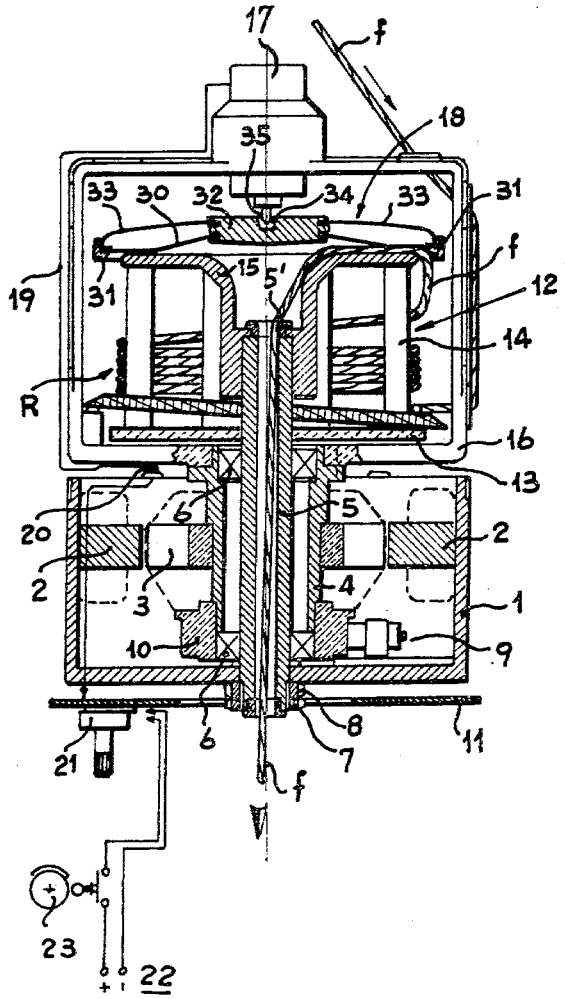
Fig. 1
Fig. 2
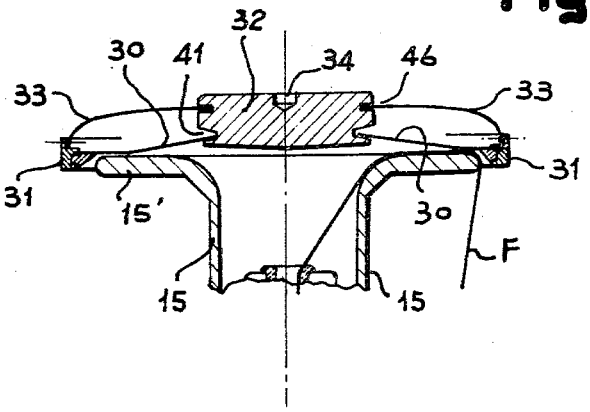

BRAKE MEANS FOR A YARN FEEDING DEVICE WITH CONSTANT ADJUSTABLE TENSION, PARTICULARLY FOR USE IN WEAVING AND KNITTING MACHINES

BACKGROUND OF THE INVENTION

The U.S. Pat. Nos. 3,940,079 and 4,161,297 relate to a yarn feeding device with constant adjustable tension, particularly designed for use in weaving and knitting machines, comprising a fixed hollow body, around which the yarn to be fed is wound into turns by means of an element rotating on the outside of said fixed body to form thereon a yarn reserve, from which the yarn is drawn to be sent to said weaving and knitting machine, passing through the inside of said fixed hollow body. According to the said patents, said feeding device comprises also adjustable brake means, cooperating with said fixed body to brake the yarn at a constant rate downstream of said yarn reserve.

The brake means claimed by the said patents comprise a braking element elastically pressed—with possibility of adjustment—against the edge of the fixed body (preferably formed by a cage) by the framework of the said rotating element. Moreover, the braking element is preferably a ring-shaped body comprising a true and proper braking ring and a set of elastic spokes converging into a hub at the centre of the ring, against said hub an adjustable screw acts which is provided at the centre of said framework, said screw being coaxial to the hollow body of the device and adapted to freely rotate in said hub.

The present invention relates to improved brake means for the feeding device of the type heretofore specified.

Experience has taught that the efficient working of the aforespecified feeding device is very largely due to the efficiency of the brake means of said device, wherefor every possible effort has been dedicated to the improvement thereof. In particular, care has been taken to assure an easy and prompt replacement of the brake means, to adapt them each time to the characteristics of the yarn being fed, and every attention has been devoted to obtaining the utmost smoothness of the braking action.

SUMMARY OF THE INVENTION

In substance the improved brake means for the yarn feeding device of the type heretofore specified, is characterized by a plurality of substantially radial elements, made of thin sheet-metal, held at the ends between an outer ring and a central hub of plastic material, said ring and said hub being further connected through radial elastic laminae. The braking action is imparted directly by the said sheet-metal radial elements, pressed onto the edge of the fixed body of the feeding device thanks to the action of a screw mounted to freely engage the centre of the hub of plastic material, the ring of plastic material of the brake means according to the invention remaining entirely external to the edge of the fixed body. Preferably, the plurality of thin sheet-metal elements is formed by laminations having their innermost part strictly radial and increasing in width towards the ring, and their outermost part forking into two sharply inclined half-elements, also increasing in width towards the ring, all the laminations being linked together into one piece with a peripheral circular crown to be connected to the outer ring of plastic material.

BRIEF DESCRIPTION OF THE DRAWINGS

The invention will now be described in further detail, by mere way of example, with reference to the accompanying drawings which show a preferred embodiment thereof and in which:

FIG. 1 is an axial section view of the yarn feeding device of the U.S. Pat. No. 4,161,297 equipped with the brake means of the present invention;

FIG. 2 is an axial section view of the brake means according to the invention, applied to the fixed body of the feeding device of FIG. 1;

DESCRIPTION OF THE PREFERRED EMBODIMENT

Figure 3:
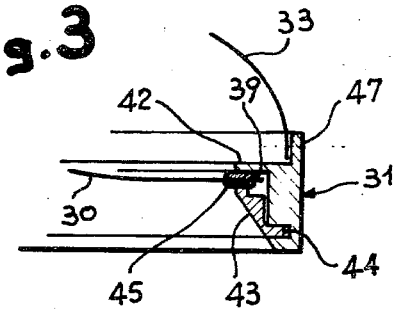
FIG. 3 shows in detail the mounting of the plurality of radial metal elements of the brake means of FIG. 2, into the plastic ring of said means.

With reference to FIG. 1, the yarn feeding device comprises a casing 1 which houses a direct current electric motor, of which may be seen the stator 2 and the rotor 3. The rotor 3 is mounted on a hollow shaft 4 which is rotatable, by means of bearings 6, about a second hollow shaft 5 which is stationary. The hollow shaft 5 is fixed, by means of threaded ring nuts 7, 8, onto the bottom of the casing 1 and projects, with an end section 5' from the opposite side of the casing. The feed brushes 9 and the commutator 10 of the motor are also indicated, while reference 11 indicates a panel containing the group of electronic circuits for controlling the reserve, the motor speed and the braking.

On the section 5' of the hollow shaft 5, projecting from the casing 1, is fixed a hollow body 12 comprising a bottom disc 13, a set of frustoconical columns 14 mounted at the periphery of the disc 13, and a funnel-shaped body 15.

Figure 4:
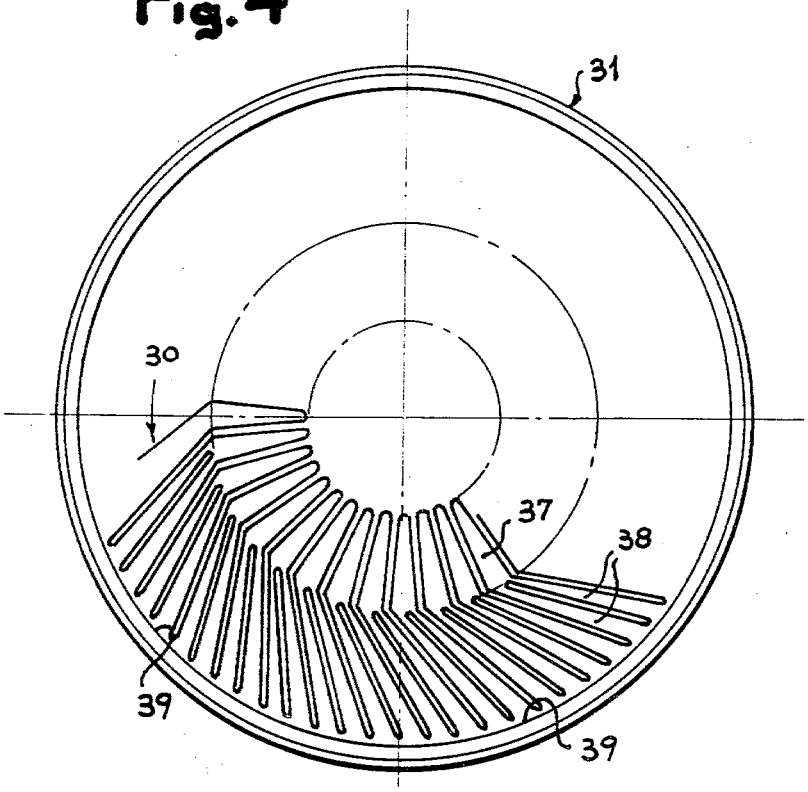
FIG. 4 is a plan view of the brake means according to the invention without the central plastic hub.

Also the rotatable hollow shaft 4 of the rotor 3 of the motor projects, by a short length, from the casing 1. To said shaft is fixedly connected a framework 16, which surrounds the hollow body 12 and carries outwardly an electromagnet 17. Between the electromagnet 17 and the hollow body 12 are arranged the brake means 18 according to the invention, shown in detail in FIGS. 2 to 4. The framework 16 is caused to rotate by the motor, to feed the yarn f for winding it onto the columns 14, in order to form a reserve R. From the reserve R, the yarn winds onto the funnel-shaped body 15, passes between the upper edge thereof and the brake 18, and then moves away passing through the fixed hollow shaft 5.

The electromagnet 17 is fed by a conductor 19, integral with the rotary framework 16 and connected through a sliding contact 20 to a potentiometer 21. In turn, the potentiometer 21 receives electric energy from a direct current source 22, either directly, or—as shown in FIG. 1—through a cam switch 23.

The brake means 18 according to the invention are shown applied (FIGS. 2 to 4) to the funnel-shaped fixed body 15 of a yarn feeding device according to FIG. 1. Of this body is clearly shown the edge 15' onto which are applied said means. These consist of a plurality of substantially radial elements 30, of thin sheet-metal, held between an external ring 31 of plastic material and a central hub 32, also of plastic material, the ring and the hub being further connected to each other by radial elastic laminae 33. As shown in FIG. 2, the brake means according to the invention are applied to the edge 15' of the fixed body 15 of the feeding device, by the outermost part of the plurality of elements 30, the ring 31 remaining completely external to the edge 15'. The yarn F passes between the elements 30 and the edge 15', against which it is elastically pressed by said elements 30, thanks to the action of an adjustable pressure element acting at the centre of the hub 32 (provided with an appropriate seat 34), said pressure element consisting of an adjustable screw or of a core 35 of the electromagnet 17 (as shown in FIG. 1).

The adjustable screw will be used in the event it is desired to keep the pressure of the elements 30 against the iron f substantially constant during operation, while enabling its adjustment from time to time. The electromagnet 17 may be used in the same manner as the screw and for the same purpose, the pressure adjustment in that latter case being performed by operating manually the potentiometer 21. However, use of the electromagnet also permits one to obtain, when desired, a cyclic variation of the pressure of elements 30 against the iron during operation, if the potentiometer 21 is fed through a rotating cam switch 23. It will be understood that the rotation of the cam switch 23 energizes in a cyclic way the electromagnet 17 through the potentiometer 21, thereby varying the axial position of the core 35 and hence the braking action of the elements 30.

Going into further details, the plurality of radial elements 30 is formed by distinct thin metal laminations extending, with their innermost part 37 in a strictly radial direction as seen in plan and increasing in width towards the ring 31, and with their outermost part 38 forking into two sharply inclined half-elements, each of said half-elements also growing in width towards the ring 31. The single laminations are then all linked together into one piece with a peripheral circular crown 39 to be connected to said ring 31 of plastic material.

The plurality of radial laminations 30 is mounted on the central hub 32 by inserting the radial ends of the single elements into a groove 41 provided on that part of the hub facing the fixed body 15 of the device to which the brake means are applied. On the external ring 31, the plurality of radial laminations is instead applied by resting the peripheral circular crown 39, which links the single elements, against a circular ledge 42 of the ring itself and by locking said crown against said ledge by means of an elastic sealing ring 43 fixed into 44 (FIG. 2). The crown 39 will preferably be provided with an elastic packing 45.

The central hub 32 and the outer ring 31, both made of plastic synthetic material, are connected to each other, as well as by the plurality of radial laminations 30, by a certain number of radial elastic liminae 33, as already heretofore specified. While the laminations connect the hub and ring parts facing the fixed body 15 of the feeding device to which the brake means in question are applied, the laminae 33 connect the external parts of the hub and of the ring. Such laminae 33 are inserted into an appropriate slit 46 of the hub 32, on one side, and they are applied by means of rivets to a circumferential projection 47 of the ring 31, on the other side. Preferably, eight laminae will be provided, which are far thicker and wider than the laminations 30.

The brake means according to the invention, heretofore described, allows one to obtain considerable improvements in the operation of the yarn feeding device of the prior art.

The use of sheet-metal laminations, as braking elements, guarantees first of all a steady adjustment which is not influenced by the changes in temperature and humidity of the working environment and which is completely uniform over the whole duration of the work.

Moreover, the braking pressure can be adjusted far more gradually thanks to the double elasticity of the system adopted, namely that of the elastic laminae 33 and that of the plurality of laminations 30.

It is moreover possible to replace extremely easily the laminations 30 by simply removing the sealing ring 43, so as to adopt laminations of a thickness suited to the type of yarn being worked (at least three different types of laminations of different thickness can be provided). The operations of replacement take place with great rapidity, as can easily be imagined.

For all these reasons, the improved brake means according to the present invention guarantee a very advantageous and satisfactory operation of the yarn feeding device according to FIG. 1, as has already been fully confirmed by the tests already carried out by the Applicant.

It is understood that any variants or modifications of the heretofore described and illustrated embodiment of the invention rightfully fall within the scope of the invention itself.

I claim:

1. Brake means for application on a yarn feeding device with constant adjustable tension, for use in weaving and knitting machines, of the type comprising a fixed hollow body around which the yarn to be fed is wound by an external rotary element, to form thereon a yarn reserve from which the yarn is drawn to be sent to said weaving or knitting machine, passing through the inside of said fixed hollow body, said brake means comprising a plurality of substantially radial elements of thin sheet-metal, held at the ends between an outer ring and a central hub of plastic material, which are moreover connected to each other by radial elastic laminae, said substantially radial elements being adapted to be pressed against the edge of the fixed body of said feeding device, to brake the yarn thereon thanks to the action of an adjustable member which freely engages the centre of said central hub, said outer ring being arranged beyond the edge of said fixed body.

2. Brake means as in claim 1, wherein the plurality of thin sheet-metal elements comprises distinct laminations having their innermost part strictly radial and increasing in width towards the outer ring, and their outermost part forking into two sharply inclined half-elements, also increasing in width towards said ring, all the laminations being linked together into one piece with a peripheral circular crown to be connected to the ring of plastic material.

3. Brake means as in claim 1, wherein the distinct innermost ends of the laminations of said plurality of radial elements are mounted on the central hub by mere insertion into a circumferential groove of the hub itself, while the peripheral circular crown linking together the laminations is applied against a ledge of the outer ring, with which it is locked by means of an elastic sealing ring fixed therein.

4. Brake means as in claim 1, wherein eight radial laminae are provided for connecting the outer ring and the central hub, said laminae being simply inserted into a peripheral slit of the central hub, at one end, and being secured to a circumferential projection of the outer ring, at the other end.

* * * * *